US005636843A

United States Patent [19]

Roberts

[11] Patent Number: 5,636,843

[45] Date of Patent: Jun. 10, 1997

[54] METHODS FOR PROP BETS FOR BLACKJACK AND OTHER GAMES

[76] Inventor: Carl Roberts, 552 N. McCarran Blvd. #226, Sparks, Nev. 89431

[21] Appl. No.: 218,017

[22] Filed: Mar. 25, 1994

Related U.S. Application Data

[63] Continuation of Ser. No. 940,563, Sep. 4, 1992, abandoned.

[51] Int. Cl.[6] ..... A63F 1/00

[52] U.S. Cl. ..... 273/292; 463/12; 463/13

[58] Field of Search ..... 273/292, 303; 463/9, 12, 13, 16

[56] References Cited

U.S. PATENT DOCUMENTS

| | | | |
|---|---|---|---|
| 4,440,398 | 4/1984 | Charon | 273/292 |
| 4,614,342 | 9/1986 | Takashima | 273/138 A |
| 4,651,997 | 3/1987 | Wood | 273/292 |
| 4,836,553 | 6/1989 | Suttle et al. | 273/292 |
| 5,013,049 | 5/1991 | Tomaszewski | 273/292 |
| 5,098,107 | 3/1992 | Boylan et al. | 273/292 |
| 5,141,234 | 8/1992 | Boylan et al. | 273/85 CP |
| 5,154,429 | 10/1992 | LeVasseur | 273/85 CP |
| 5,167,413 | 12/1992 | Fulton | 273/85 CP |
| 5,174,579 | 12/1992 | Griffiths | 273/292 |
| 5,248,142 | 9/1993 | Breeding | 273/292 X |
| 5,257,810 | 11/1993 | Schorr et al. | 273/292 |

OTHER PUBLICATIONS

Gaming Concepts, Inc. Over/Under/13™ Blackjack. ©1988.

John Scarne's *Encyclopedia of Games* (1973).

*Primary Examiner*—Raleigh W. Chiu
*Assistant Examiner*—Michael O'Neill
*Attorney, Agent, or Firm*—Foster & Foster

[57] ABSTRACT

Apparatus and methods for adding side or prop wagers to betting games, particularly the games of Blackjack and Poker. A Blackjack table is disclosed which comprises betting spots each of which comprises indicia describing a side or prop bet combination and odds offered for a wager against the combination. A video Blackjack machine is disclosed which is played with and without side or prop bets. A special Blackjack side or prop bet entry keyboard is disclosed. A video Poker machine is disclosed which is also played with and without prop bets. A special Poker side or prop bet entry keyboard is disclosed. The Poker keyboard is a subset of the Blackjack keyboard permitting Poker to be played with and without side or prop bets on the video Blackjack machine.

5 Claims, 5 Drawing Sheets

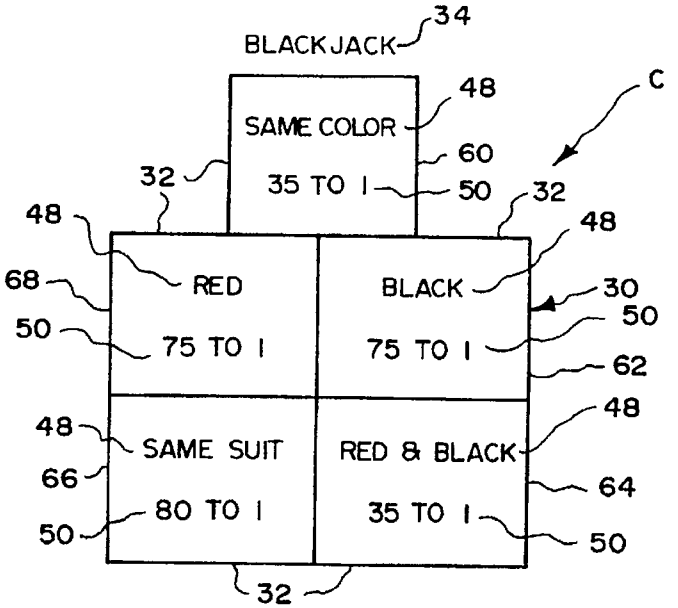
FIG. 4
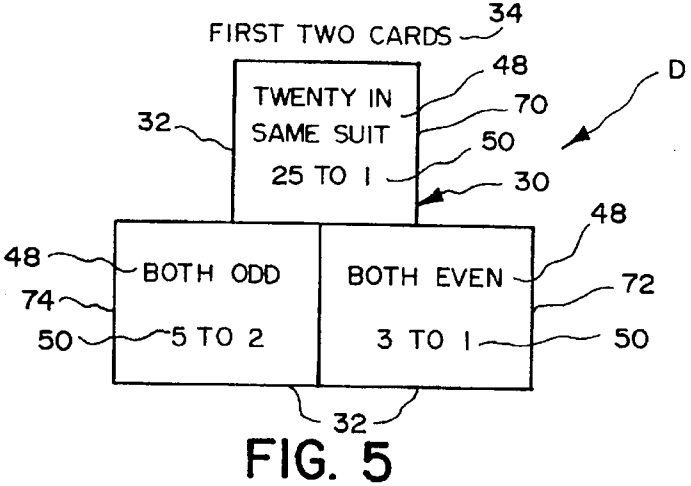
FIG. 5
FIG. 6
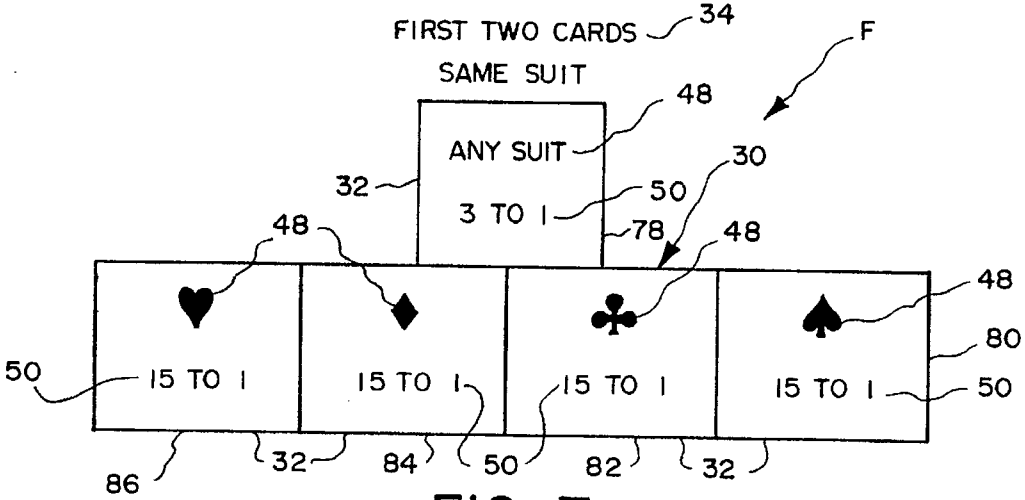
FIG. 7

METHODS FOR PROP BETS FOR BLACKJACK AND OTHER GAMES

CONTINUITY

This application is a continuation of my U.S. Patent application Ser. No. 07/940,563, filed Sep. 4, 1992, now abandoned.

FIELD OF INVENTION

This invention relates to the game of Blackjack and to other betting games which are played at a table or on a video machine. More specifically the invention relates to providing predetermined rules and provisions for additional opportunities for betting within each hand to enhance the excitement of the game otherwise being played under normal rules.

DESCRIPTION OF RELATED ART

The game of Blackjack is well known and played on tables in casinos world-wide. Other than doubling of bets under restricted circumstances, betting is most often limited to a single bet of the value of a player's hand versus the value of a dealer's hand. Under these conditions, the interest level of the game is often closely tied to the amount of each current wager.

Video Blackjack and Poker games are also well known and used in gaming establishments world wide. Operating, betting, and pay-out rules programmed into the video games follow well known patterns and rules. Odds for both table versions and video versions of Blackjack and Poker are often set by state authorities with some room for modification by casino owners.

BRIEF SUMMARY AND OBJECTS OF THE INVENTION

In brief summary, this novel invention increases interest and volume of per hand betting while adding spice to the table game of Blackjack and to video games comprising Blackjack and Poker. In general, the invention comprises opportunity while playing a basic game of Blackjack or Poker or other betting game played with a plurality of cards for adding one or more side or prop bets in a predetermined manner and at predetermined odds at the same time the basic game is being played.

To incorporate this invention into a table Blackjack game, a betting band or betting spots are added to the table surface whereupon each side or prop bet is placed. The betting band or spots display the nature and pay-out odds for each bet which is made by placing chips on the display surface within each band or spot, selected for a side of prop bet wager.

In video Blackjack or Poker or other video betting game, before each hand is played, either a standard keyboard is used to select side or prop bets from prompts on the video screen or a special keyboard is used to directly select the side or prop bets. In some cases, a combination of a special keyboard and video screen prompts are used for selecting and making the side or prop bets. As the video game is computer based, the number of different side or prop bets which may be selected and wagered against is astronomically large providing a broad based challenge for an innovative mind. Of course, the computer based video game has inherent capability for limiting the number, combinations and odds of the bets, permitting each casino to control and limit exposure in each video game machine.

Accordingly, it is a primary object to provide a betting band or a plurality of betting spots whereat a player can make side or prop bets for combinations of cards delivered during normal table play of a game of Blackjack.

It is an important object to provide indicia at the site of each betting band or betting spot to define a card combination and other betting conditions against which a wager is made prior to beginning play of each hand and promised pay-out for the wager should the combination occur during normal play of the Blackjack game.

It is another primary object to provide a programmable video Blackjack game device which permits entry and pay-out of side or prop bets as an added mode of play of the device.

It is another important object to provide a video Blackjack game device which comprises a special keyboard for direct operator selection and communication of side or prop bets to the Blackjack game device.

It is still another primary object to provide a programmable video Poker game device which permits placing side or prop bets and related selection display and pay-out as an added mode of play of the device.

It is still another important object to provide a video Poker game device which comprises a standard keyboard and video displays for communicating side or prop bet selection criteria and selected side or prop bets between a player and the device.

It is yet another important object to provide a video Poker game device which comprises a special keyboard for direct operator selection and communication of side or prop bet selections to the game device.

These and other objects and features of the present invention will be apparent from the detailed description taken with reference to accompanying drawings.

BRIEF DESCRIPTION OF THE DRAWINGS

FIG. 4 is a betting area diagram showing detailed indicia on betting spots designated as player site C in FIG. 1.

FIG. 5 is a betting area diagram showing detailed indicia on betting spots designated as player site D in FIG. 1.

FIG. 6 is a betting area diagram showing detailed indicia on a betting spot designated as player site E in FIG. 1.

FIG. 7 is a betting area diagram showing detailed indicia on betting spots designated as player site F in FIG. 1.

DETAILED DESCRIPTION OF THE ILLUSTRATED EMBODIMENTS

Figure 1:
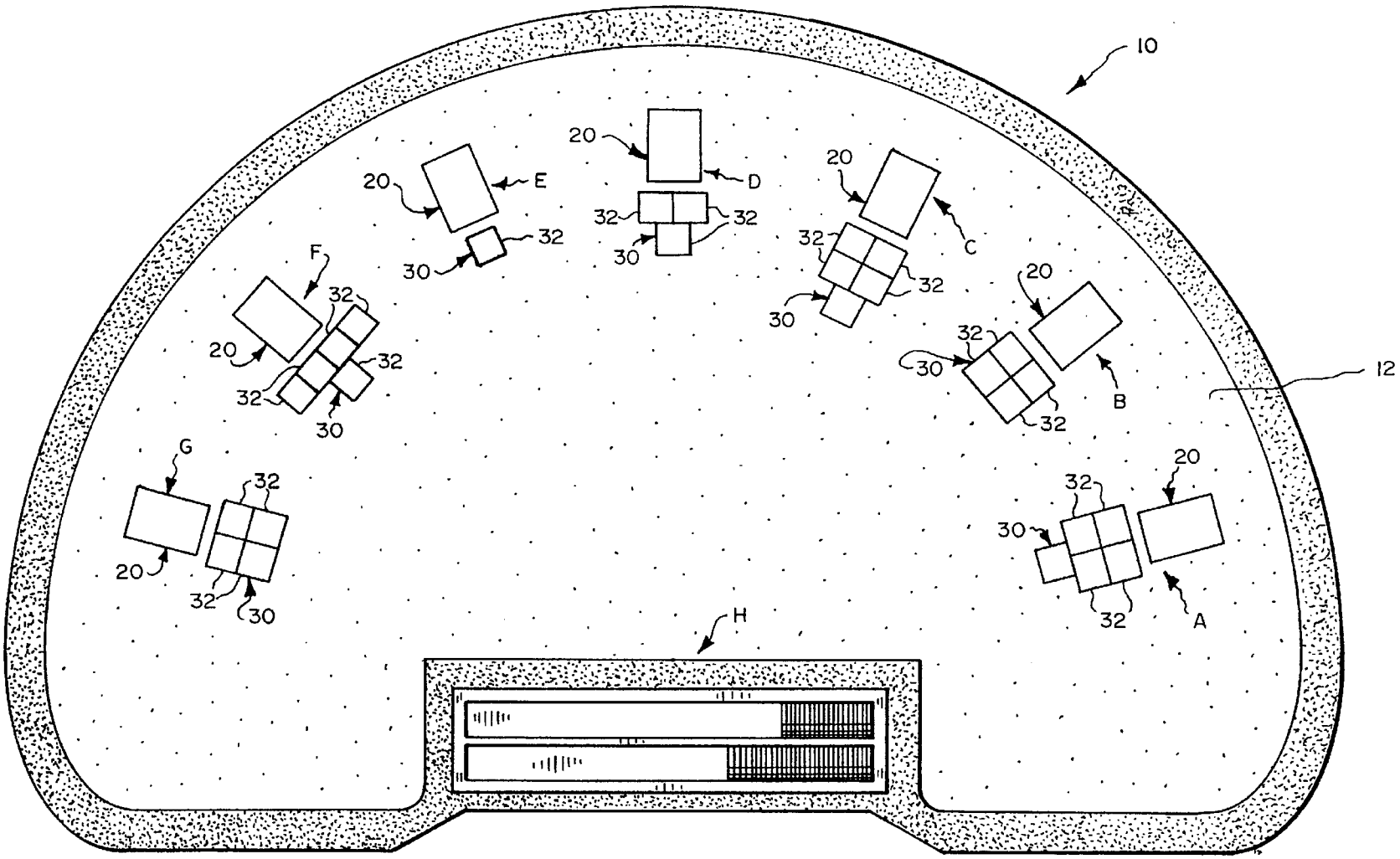
FIG. 1 is a top elevation of a Blackjack gaming table comprising a side or prop bet area comprising at least one betting spot at each player site.

Reference is now made to the embodiments illustrated in FIGS. 1–12 wherein like numerals are used to designate like parts throughout. In a first table played embodiment of the invention, a Blackjack table 10 is seen in FIG. 1. Blackjack table 10 may be provided in a number of forms for varying numbers of players. In the embodiment seen in FIG. 1, Blackjack table 10 comprises seven player positions A through G, respectively, and a dealer station H as displayed on table top 12. Each player position A through G comprises a Blackjack betting and playing site 20 and at least one side or prop betting spot area, generally designated 30.

Each side or prop betting spot area 30 comprises at least one side or prop betting spot 32. As seen FIG. 1, the combination of side or prop betting spots 32 within each area 30 may be similar in shape and numbers of betting spots 32 to one or more areas 30 or dissimilar to any other area 30. As an example, the shape and numbers of betting spots 32 of player positions B and G are the same while the number of betting spots 32 of player position D is like no other area 30.

Figure 2A:
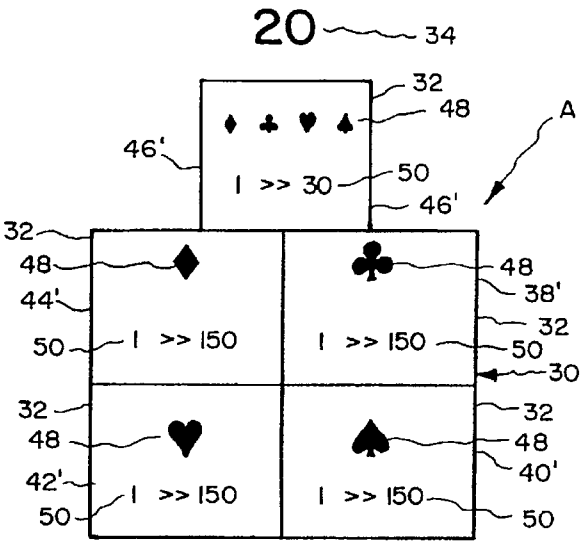
FIG. 2A is a betting area diagram showing the same betting spots as FIG. 2, but without language indicia in FIG. 1.
Figure 2:
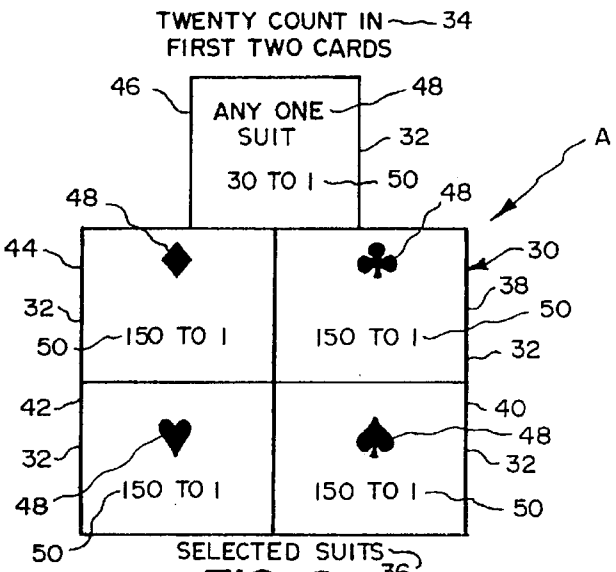
FIG. 2 is a betting area diagram showing detailed indicia on betting spots designated as player site A in FIG. 1.

A first example of the use of betting areas 30 is seen in FIG. 2 whereupon one or more side or prop bets related to a player at position A receiving two cards which sum to twenty is made. Player position A area 30 comprises an upper indicia field 34, a lower indicia field 36, and five player spots 32, individually designated 38, 40, 42, 44 and 46.

Placed at the top of player position A area 30, indicia field 34 generally defines the basis of the bet, in this case, "TWENTY COUNT IN [the] FIRST TWO CARDS". Lower indicia field 36 provides instruction specific to spots 38, 40, 42, and 44. Each spot 38–46 comprises two lines of indicia, a top line 48 and a bottom line 50. Top line 48 comprises indicia implying suit selection which may be a specific suit or any one suit. Bottom line 50 provides the odds of the bet. Note that the odds are provided for illustrative example and may be revalued as required by a game maker, a state authority or a casino operator. In all cases odds presented herein are examples and should be considered to be subject to change but are also informative as to general value of a wager for a betting combination. Similarly the geometry and mode of presentation of indicia on of spots 32 should also be considered generally as exemplary with many different geometries and modes of presentation possible within the scope of invention.

As an example, betting area 30 of FIG. 2A provides essentially the same betting information as that found in FIG. 2, but the betting information is provided without language based indicia. Where the function of a spot 32 in FIG. 2A is the same as a spot 32 in FIG. 2, the reference number of spot 32 in FIG. 2A is delineated by the number followed by a prime. Again it should be noted that the scope of the invention is not limited by the type or mode of presentation or symbols used.

Figure 3:
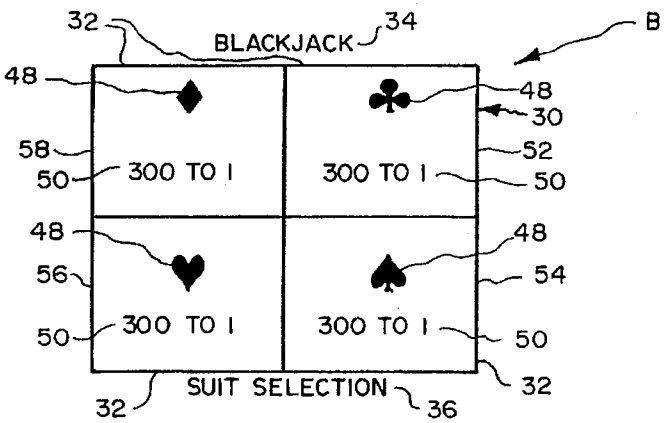
FIG. 3 is a betting area diagram showing detailed indicia on betting spots designated as player site B in FIG. 1.

Referring to FIG. 3, player position B is seen to comprise a specific blackjack suit selection, wherein both cards in a player's blackjack must be in the same selected suit to win. Player position B area 30 comprises four side or prop betting spots 52, 54, 56 and 58, each of which provides for betting against a blackjack comprising only cards of a particular suit being dealt to a player. At the top, indicia field 34 delineates a Blackjack side or prop bet and lower indicia field 36 denotes each spot 32 comprising a suit selection opportunity.

Side or prop betting area 30 for player position C is seen in FIG. 4. Therein betting area 30 comprises five side or prop betting spots 60, 62, 64, 66 and 68. Top indicia field 34 again defines "BLACKJACK" as the basis of the bet, but in this case the bet for prop betting spot 60 is provided for betting against the event that both blackjack cards dealt to the player have the same color. Spot 62 is provided for betting against the event that both blackjack cards dealt to the player are black. Spot 68 is provided for betting against the event that both blackjack cards are red, and spot 64 is provided for betting against the event that one card in a blackjack dealt to the player is black and the other card is red. Spot 66 defines a bet that both blackjack cards dealt to the player are in the same suit.

FIG. 5 depicts a three spot side or prop spot 32 betting area 30 for player position D and involves a wager based upon the first two cards received by a player at position D. Top indicia field 34 communicates a wager against the "FIRST TWO CARDS" received by the player at position D. Side or prop betting area 30 at position D comprises three betting spots 70, 72 and 74. Betting spot 70 comprises space for making a bet against a combination of a count of twenty in the same suit paying 25 to 1, betting spot 72 comprises space for betting against a combination of two even cards and betting spot 74 comprises space for betting against a combination of two odd cards. Note that the odds are not the same for even and odd cards, as there are more odd cards in a Blackjack playing deck than even cards.

FIG. 6 illustrates a betting combination involving the first two cards dealt to a player at position E. As indicated by top line 48, the combination of side or prop bet spot 76 comprises any "PAIR" and pays bottom line 50 indicates a pay-out of 15 to 1.

Betting combinations seen in FIG. 7 comprise wagers associated with the first two cards dealt to a player in position F being of the same suit. Position F area 30 comprises five side or prop bet spots 78, 80, 82, 84, and 86. Spot 78 provides space for making a wager against the first two cards dealt the player at position F being in the same suit and pays 3 to 1. Spots 80, 82, 84 and 86 are associated with each particular suit of spades, clubs, diamonds, and hearts, respectively, and a wager in the space of each spot 80, 92, 84 and 86 has pay-out odds of 15 to 1.

Figure 8:
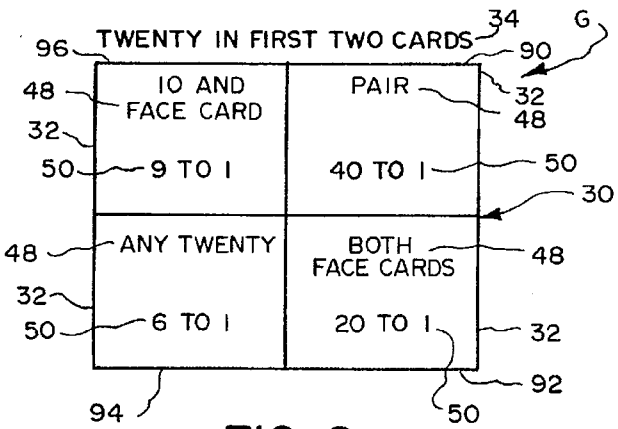
FIG. 8 is a betting area diagram showing detailed indicia on betting spots designated as player site G in FIG. 1.

As seen in FIG. 8, similar to area 30 of player position A, area 30 of player position G provides for side or prop bets based upon the first two cards dealt to the player in position G having a combined total of twenty as instructed in upper indicia field 34. Four side or prop bet spots 90, 92, 94 and 96 are provided at player position G. Prop spot 90 offers odds of 40 to 1 against a pair totaling twenty. Prop spot 92 offers odds of 20 to 1 against both cards being face cards while any combination of twenty as depicted in prop spot 94 offers odds of 6 to 1. A combination of a ten card and a face card as seen in prop spot 96 offers odds of 9 to 1.

The examples of areas 30 of player positions A through G are but a small proportion of the different combinations of side or prop bets which may be provided for a player within the scope of the invention. Other examples of side bet opportunities are:

1. Three sevens, comprising the first two cards dealt a player and the dealer up card paying 5000 to 1.

2. The first card received by a player will be a card from a group comprising aces, twos, threes and fours paying 2 to 1.

3. The first two cards received by a player will be cards from the group comprising aces, twos, threes and fours paying 9 to 1.

4. The first two cards received by a player and the dealer up card will be cards from the group comprising aces, twos, threes, and fours paying 27 to 1.

5. The first two cards received by a player will be cards in the same suit from the group comprising aces, twos, threes and fours paying 40 to 1.

6. The first two cards received by a player and the dealer up card will each be cards of the same suit from the group comprising aces, twos, threes, and fours paying 80 to 1.

7. The first card received by a player will be a ten count card (i.e. a ten, jack, queen, or king) paying 2 to 1.

8. The first two cards received by a player and the dealer up card will each be ten count cards paying 27 to 1.

9. A sum of twenty from preselected cards such as a king and a queen or a ten and a jack paying 150 to 1.

10. The first two cards received by a player and the dealer up card will constitute a three card straight flush paying 1000 to 1.

The above opportunities constitute a number exemplary combinations, but many others are available using pairs, triples and four card combinations (using the players and the dealers hands together). In fact, all combinations of one to four cards may be used and betting odds calculated and offered as desired by a Blackjack table designer or casino operator.

Table 10 may be designed to comprise a plurality of betting areas 30 which are identical or to comprise a mixture of betting combinations. In any event, an area 30 is provided for each player comprising at least one side or prop betting spot 32 to add additional spice to the game of Blackjack.

Similar side or prop betting can be set up for other betting games, such as poker. Such side betting is particularly effective for stud poker as four to six cards are dealt face up to each player. During play of the game of Blackjack with side or prop bets, the side or prop bets are placed, unless otherwise specified by the dealer or casino, at before each hand is dealt.

In another embodiment, the invention is incorporated into a programmable automatic video Blackjack machine. Such a video Blackjack machine may be programmable similar to machines currently used for standard or regular Blackjack play or may be a special video Blackjack machine specifically designed and built to incorporate side or prop betting. In any event, the basic game of Blackjack is played in the standard or regular manner. However, prior to the play of the hand, or in some cases, prior to the play of each card, a player adds an additional wager by insertion of coins or by some other increase of the wagered amount to bet on selected prop bet combinations.

Figure 9:
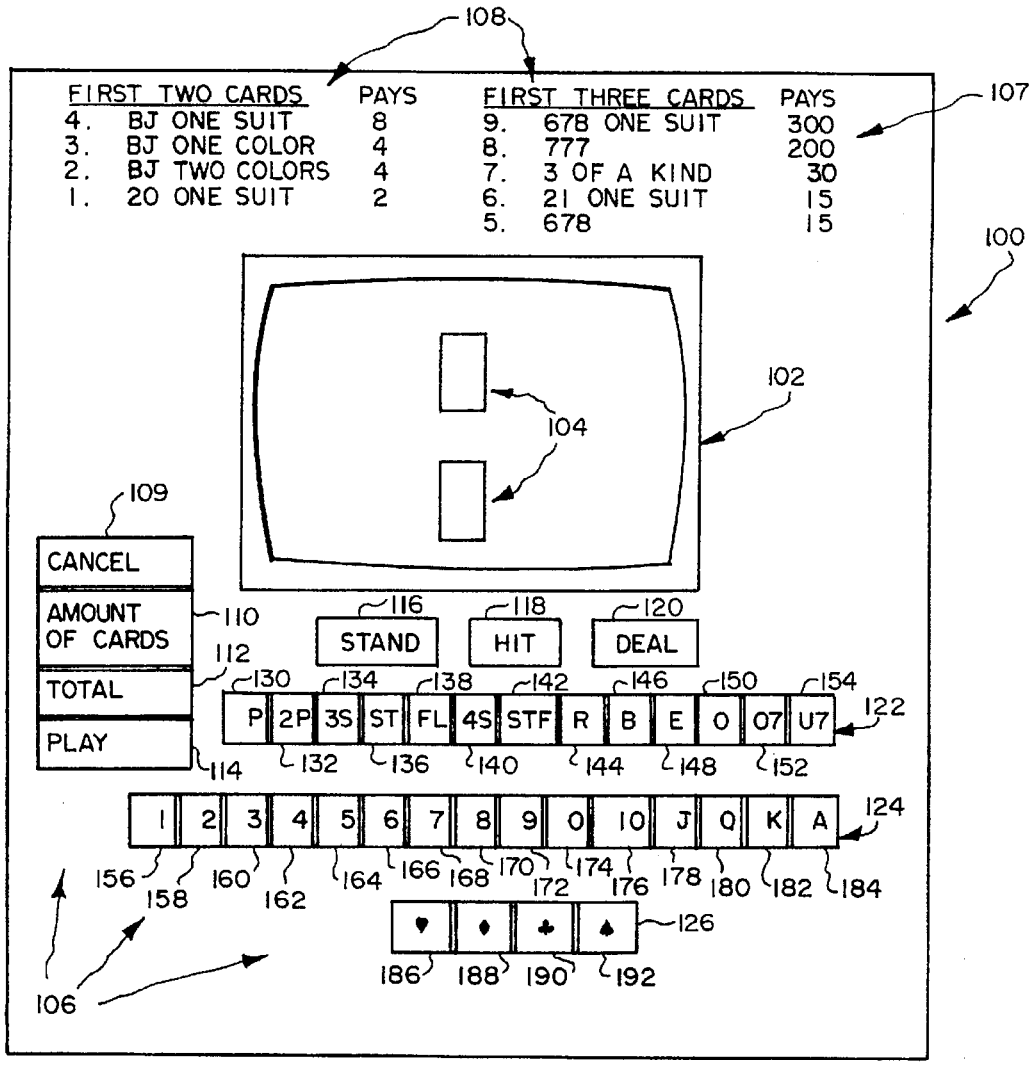
FIG. 9 is a frontal elevation of a Blackjack video game machine comprising a player entry keyboard and a screen which displays programmably changeable player/machine interactive indicia.
Figure 10:
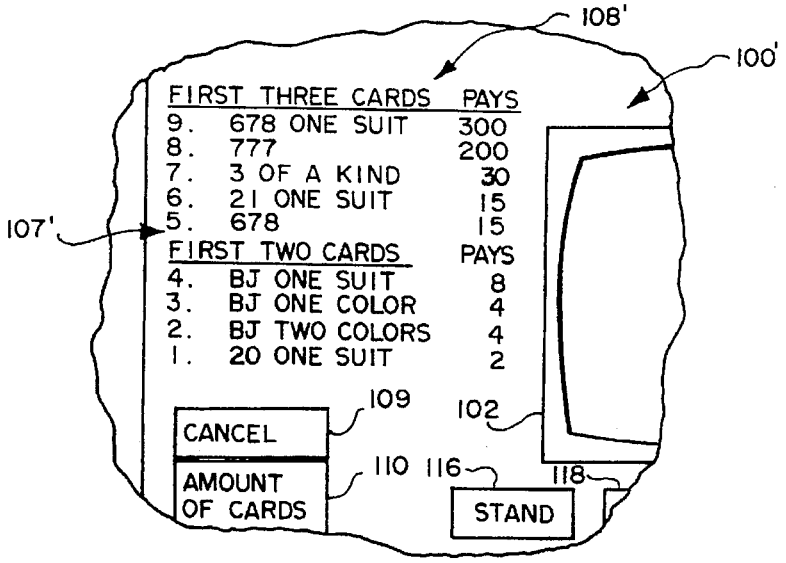
FIG. 10 is a fragmentary frontal elevation of a Blackjack video game machine comprising laterally disposed side or prop bet instructive indicia.

Referring to FIG. 9, a video Blackjack machine 100 is seen to comprise a video screen 102 which displays programmably variable video machine generated indicia, generally designated 104, a player keyboard 106, and player instruction indicia 108. In FIG. 9, indicia 108 comprises card combinations and betting odds for keyboard selectable side or prop bets and is disposed for player viewing at the top viewing surface 107 of machine 100. In the fragmentary presentation of FIG. 10, similar indicia 108' is seen laterally disposed at a viewable side 107' of screen 102 of a video Blackjack machine 100', which is similar in all ways to machine 100, except in the position of indicia 108' relative to video screen 102.

Figure 11:
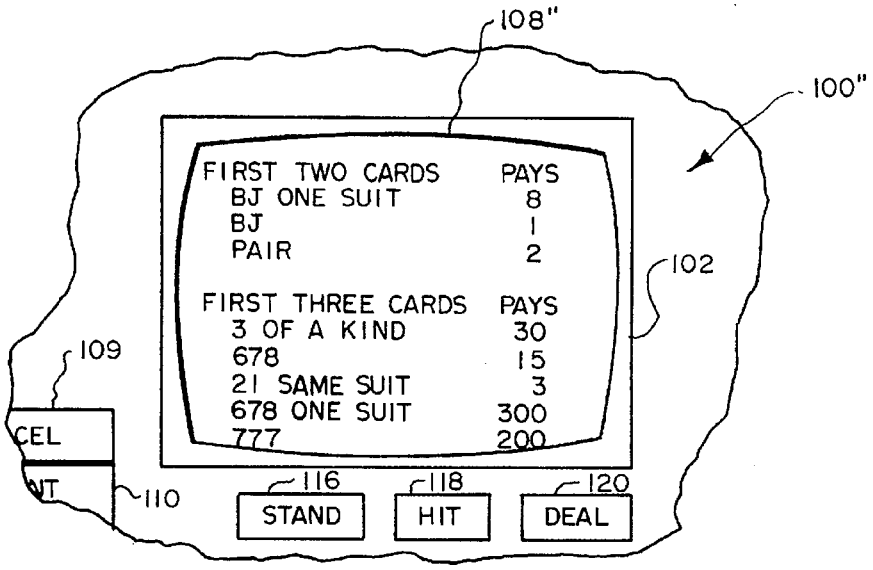
FIG. 11 is a fragmentary frontal elevation of a Blackjack video game machine comprising programmably generated side or prop bet instructive indicia on a video screen.

In an embodiment of a video Blackjack machine 100" seen FIG. 11, indicia 108" is disposed on screen 102 before card icons and other play instructions are displayed during play of the next hand or card in the hand. In the embodiment of FIG. 11, all side or prop bet combinations or odds are displayed on screen 102. Video Blackjack machines 100' and 100" comprise the same keyboards combinations described hereafter for machine 100.

In each case, indicia 108, 108' and 108" display preferred or popular side or prop bet selections and the odds for each side or prop bet selection. It should be noted that some combinations pay more than others, based upon the statistical likelihood of the occurrence of a particular combination.

Referring again to FIG. 9, keyboard 106 comprises four general game control switches, CANCEL switch 109, AMOUNT OF CARDS switch 110, TOTAL switch 112, and PLAY switch 114; three Blackjack play switches, STAND switch 116, HIT switch 118, and DEAL switch 120; a row of side or prop bet selections switches 122; a row of card and numeric entry switches 124; and a row of suit selection switches 126.

The row of side or prop bet selection switches 122 comprises switches 130, 132, 134, 136, 138, 140, 142, 144, 146, 148, 150, 152, and 154, each of which bear a functional abbreviation. The abbreviation "P" on switches 130 and 132 stands for a pair. The abbreviation "3S" on switch 134 stands for three cards of the same value, such as three sixes or three sevens. The indicia "ST" on switch 136 stands for a straight or a series of cards in numeric sequence. The abbreviation "FL" on switch 138 stands for a flush or cards all in the same suit and "4S" on switch 140 means four cards of the same value. Indicia "STF" on Switch 142, stands for a straight flush. The abbreviations "R" and "B" on switches 144 and 146 stand for red and black, respectively. Similarly, "E" and "0" on switches 148 and 150 stand for even and odd, respectively. The indicia "07" on switch 152 and "U7" on switch 154 stand for cards having values over seven and under seven, respectively.

The row of switches 124 comprises switches 156, 158, 160, 162, 164, 166, 168, 170, 172, 174, 176, 178, 180, 182 and 184. Switches 156 through 172 provide for numerical entry of the number 1 through 9, respectively, and are used as numbers when appropriate or as indications of cards 1 through 9, respectively, as well. Switch 174 enters a zero and, as such, is used only in numeric entry. On the other hand, switches 176, 178, 180, 182, and 184 are each used for entering a card value of ten, jack, queen, king, and ace, respectively.

The bottom row of switches 126 comprises switches 186, 188, 190 and 192 used for entry of suit selections of hearts, diamonds, clubs, and spades, respectively.

To play a game of Blackjack with side or prop bets, a player begins each game by selecting the number of hands to be played during the current deal and inserting coins to cover the Blackjack wager for each hand. Once basic Blackjack betting against each selected hand is completed, the player presses PLAY switch 114 to begin setting up side or prop bets. Coins for a next side bet are inserted into machine 100 and a side bet selection is made. As an example, if the player desires to bet that the first two cards received during play of the hand will total 20, switch 156 is depressed. Machine 100 records the side bet and displays the side bet selected and pay-out odds on the screen.

If the player desires to make a second side bet, PLAY switch 114 is pressed again and coins are inserted into machine 100 or coins are inserted without pressing PLAY switch 114 to initiate the second side bet. As an example, in this second bet, if the player elects to wager that the first two cards received in the hand will be a pair of sixes, switches 130 and 166 are pressed in any order. In this case, machine 100 displays the selected bet and odds associated with the bet.

If the player decides to cancel a side bet selection, CANCEL switch 109 is depressed and a new side bet is entered for the last inserted coins as described above. When the player has made all of the side bets preparatory to playing the hand, DEAL switch 120 is depressed to deal the cards. The player then watches dealt card indicia 104 which appear on the screen and completes play by selectively depressing switches 118 and 116 to hit or stand, respectively, as the regular game of Blackjack is played. At the end of the game, machine 100 pays on both winning Blackjack and side or prop bets.

Other side or prop betting options comprise betting on the number of cards needed to make twenty-one, the suits of the cards that-show in the hand of the dealer and the hand of the player or on the suits which do not show therein, whether a face card shows in cards received, whether numbered cards do not show in cards received, whether a blackjack will be all red cards, whether a blackjack will be all black cards, and whether a blackjack will comprise one red and one black card. Betting options are directly selected by pressing switches of keyboard 106 or by pressing switches of keyboard 106 to select options from screens provided on display screen 102.

In the embodiment seen in FIG. 11, indicia 108" comprises a program controlled display of interactive player/machine 100" screens. Such screens may also be used in machines 100 and 100' in special circumstances. In such cases, a mode selection screen, permitting interactive mode selection provides options comprising (1) select number of prop bets to play, (2) display of odds for keyboard selected prop bets, (3) display of odds for popular prop bets, and (4) enter prop bets is used to permit a player to more effectively interact with machine 100". Of course interactive player/machine 100" screens may be written and provided in many other forms as is well known in the art and which is within the scope of the invention.

Through use of keyboard rows 122, 124 and 126, a player may choose all, part or none of standard prop bet combinations prior to play of each Blackjack hand. In any event, each player selects prop bets to be played for each next hand from a predetermined menu of prop bets programmably stored in each machine 100, 100' and 100". The predetermined menu is selectively restricted by programming to limit unwanted prop bet combinations. As an example, a casino may wish to delete the opportunity to place a prop bet against a royal flush which may have odds of 100,000 to 1.

The player may choose to play just one, two or three or more combinations of cards dealt to the player or to the player and the dealer against a single prop bet. If so, the one combination pays more than if more than one combination is played on the single prop bet.

A player may also elect to place a side or prop bet against multiple combinations. As an example, the player may elect to place a side or prop bet against the first five combinations seen in indicia 108 in FIG. 9. Then within the first five combinations, the player may also selectively bet against each combination separately, inserting the desired number of coins for each combination and pressing switches 156 through 164 to make individual selections.

Each machine 100, 100' and 100" is programmed to have standard prop bet combinations as depicted by examples of indicia 108, 108' and 108", respectively. However, through the use of keyboard rows 122, 124 and 126 and switches 110 and 112, each player selectively adds to the standard combinations. As an example, an added side or prop bet comprises pressing switch 130 and switch 172 in sequence which selects a pair of nines as a side or prop bet. In this case, programmably calculated odds pay several times more than a prop bet against a pair more generally comprising any card value.

A fifty-two card deck is used in the programmed logic for Video Blackjack machines 100, 100' and 100". For the table Blackjack game, multiple decks are often used and odds calculations which are different than odds of a single deck are made based upon the number of decks used. It is expected that ranges for side or prop bet odds on both table and video games would be set by ruling state authorities and varied within the range by casino owners.

Figure 12:
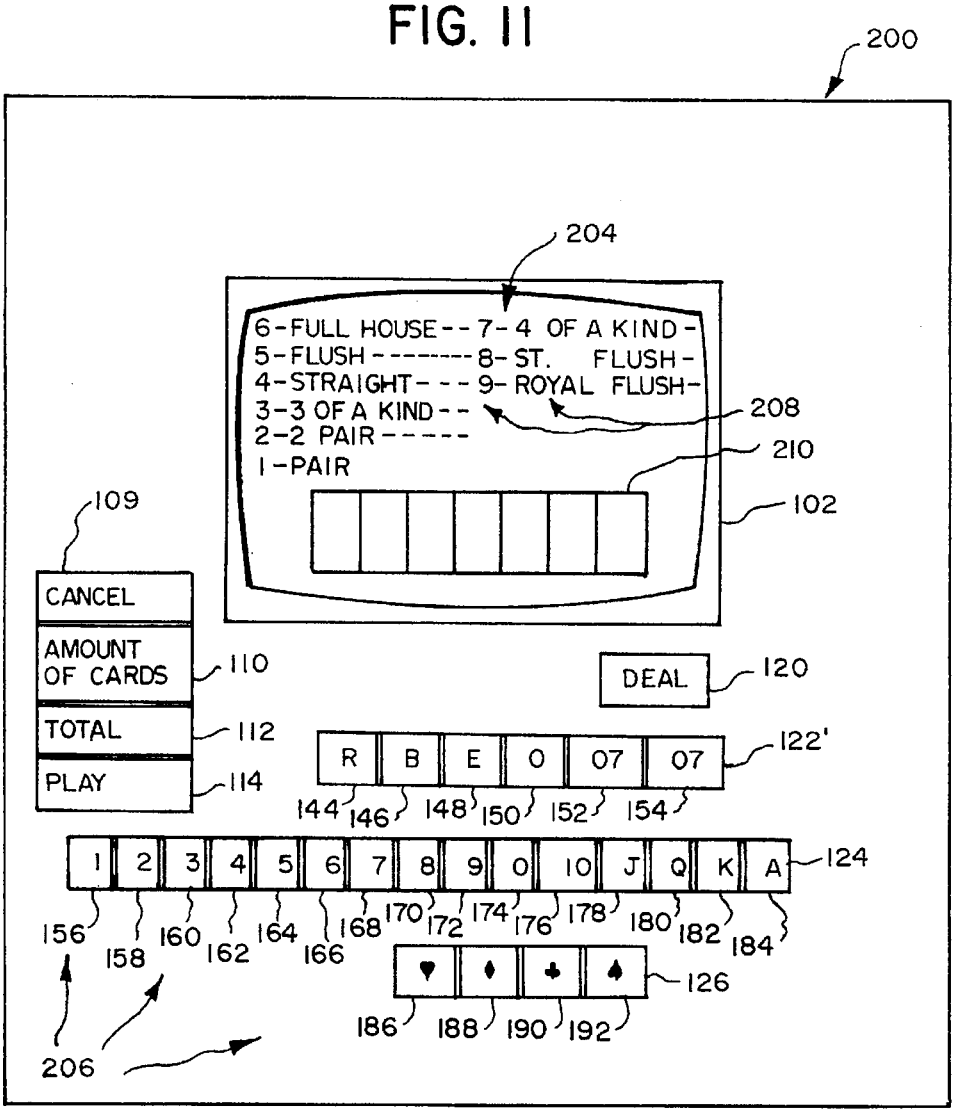
FIG. 12 is a frontal view of a Poker video game device comprising a special keyboard and an interactive prop or side bet selection screen.

Referring to FIG. 12, a video Poker machine 200 is seen to comprise a video display screen 102 and a player keyboard 206. The video display screen displays programmably variable video machine generated indicia, generally designated 204, and comprises player side bet selection indicia 208.

In the case of indicia 208, an exemplary standard set of selectable side or prop bets is disposed at the top of machine screen 102 and comprises side or prop bet opportunities to bet against (1) a pair, (2) two pairs, (3) three of a kind, (4) a straight, (5) a flush, (6) a full house, (7) a four of a kind, (8) a straight flush, (9) a royal flush. The game is played free of wild cards or with a Joker or deuces wild if preferred. The rules for playing the basic game of Poker is the same as the game of table Poker.

Keyboard 206 comprises four general game control switches, CANCEL switch 109, AMOUNT OF CARDS switch 110, TOTAL switch 112, and PLAY switch 114; a DEAL switch 120; a row of side or prop bet selections switches 122'; a row of card and numeric entry switches 124; and a row of suit selection switches 126.

The row of side or prop bet selection switches 122' comprises switches 144, 146, 148, 150, 152, and 154, each of which bear a functional abbreviation. The abbreviations "R" and "B" on switches 144 and 146 stand for red and black, respectively. Similarly, "E" and "O" on switches 148 and 150 stand for even and odd, respectively. The indicia "07" on switch 152 and "U7" on switch 154 stand for cards having values over seven and under seven, respectively.

The row of switches 124 comprises switches 156, 158, 160, 162, 164, 166, 168, 170, 172, 174, 176, 178, 180, 182 and 184. Switches 156 through 172 provide for numerical entry of the number 1 through 9, respectively, and are used as numbers when appropriate or as indications of cards 1 through 9, respectively, as well. Switch 174 enters a zero and, as such, is used only in numeric entry. On the other hand, switches 176, 178, 180, 182, and 184 are each used for entering a card value of ten, jack, queen, king, and ace, respectively.

The bottom row of switches 126 comprises switches 186, 188, 190 and 192 used for entry of suit selections of hearts, diamonds, clubs, and spades, respectively.

As keyboard 206 includes a number and position of switches which comprise a subset of the switches of keyboard 106, it is should be readily apparent to one skilled in the art that a Blackjack machine, such as machine 100", can be used to play Poker as well as Blackjack, simply by additional programming of machine 100".

To play a game of Poker with side or prop bets, a player begins each game by selecting the number hands to be played on the current deal and inserting coins to cover the Poker ante for each hand. Once the initial Poker ante is inserted, the player presses PLAY switch 114 to begin setting up side or prop bets. Coins for a next side bet are inserted into machine 100 and a side bet selection is made. As an example, if the player elects to bet against a full house, switch 172 is depressed. Machine 100 records the side bet and displays the side bet selected and associated odds on screen 102.

If the player desires to make a second side bet, PLAY switch 114 is pressed again and coins are inserted into machine 200 or coins are inserted after completing switch entry for the first side or prop bet to initiate the second side bet. In this case, if the player elects to wager that the first two cards received in the hand will be red switches 144, 110 and 158 are pressed in that order. As a result, machine 200 displays the selected bet and odds associated with the bet.

If the player decides to cancel a side bet selection, switch 109 is depressed and a new side bet is entered for the last inserted coins as described above. When the player has made all of the side bets preparatory to playing the hand, DEAL switch 120 is depressed to deal the first cards. The player then watches dealt card indicia 104 which appears on the screen and completes play by selectively depressing switches 120 and betting on successive cards as is standard in the table game of Poker. At the end of the game, machine 100 pays on both winning Poker and side or prop bets.

Other side or prop bet options comprise betting that the first two dealt cards total twenty, the first two cards dealt to the player's hand are in the same suit, three consecutively dealt cards are sevens (7—7—7), any pair in the player's hand, first two cards in the player's hand are even, the first three cards dealt the player sum to 21 by Blackjack rules, a Blackjack in the first two cards, and a sequence of cards totals 21 (i.e. 6–7–8). Of course it should be readily apparent that the examples of side bets provided above are only a fraction of the total number of side bets available within the scope of the invention.

In the embodiment seen in FIG. 12, indicia 208 comprises a program controlled display of interactive player/machine 200 screens. In such cases, a mode selection screen, permitting interactive mode selection provides options comprising (1) select number of prop bets to play, (2) display of odds for keyboard selected prop bets, (3) display of odds for popular prop bets, and (4) enter prop bets. Of course interactive player/machine 200 screens may be written and provided in many forms as is well known in the art and mentioned earlier herein. Through use of keyboard rows 122, 124 and 126, a player may choose all, part or none of standard prop bet combinations prior to play of each Poker hand.

As an example of keyboard use in setting up a side or prop bet, setting up the prop bet of a sequence of cards totalling 21 (6–7–8) is accomplished by depressing switch 160 immediately after pressing the play button, after anteing or after completing entry of a prior side or prop bet. Following, in sequence, switch 110 is depressed followed by switch 160 to indicate three cards in the side bet. Next, switch 112 is depressed followed in seriatim by switches 158 and 156, thereby communicating a total of 21. By this sequence, the side bet against the first three player received cards comprising 6–7–8 is entered. Indicia on display screen 102 confirms entry and displays the associated odds. All cards dealt and odds calculated are based on a fifty-two card deck.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A method of playing a single card game based upon cards dealt to a player from a deck of playing cards comprising:

providing a deck of playing cards;

providing a game table with a table top area, a dealer's position, at least one player's position, a first wager area on the table top area adjacent to the player's position and plural second wager areas on the table top area adjacent to the player's position;

the player placing a first wager based upon the outcome of the game involving the cards and based upon the winning of the card game, wherein the first wager is placed upon the first area adjacent to the player's position on the table top area;

the player placing at least two second prop wagers independent from playing the card game itself and whether said player wins the card game, the second prop wager is based upon the player playing for an occurrence of one or more suit, color, face card or odd and even numbered combinations of all cards that are dealt from the deck to the player during the card game, the second wager is placed upon the second area adjacent to the player's position;

the dealer dealing a hand of cards to the player;

the dealer selectively dealing or not dealing a card or cards to the player based upon the decision of the player;

the dealer paying the player a benefit when the player wins the first wager based upon the winning of the card game;

the dealer paying the player a benefit when the player wins any second wager based upon the occurrence of one or more suit, color, face card or odd and even numbered combinations of cards as of the end of the game, independent of whether the player wins the first wager.

2. The method of claim 1 wherein the first and second wagers are physically placed under the control of the player upon separate sites on a custom surface of a table.

3. The method of claim 1 wherein the card game is black jack.

4. The method of claim 1 wherein the card game is poker.

5. A method of playing a single card game based upon cards dealt to a player from a deck of playing cards comprising:

providing a simulated deck of playing cards by a video machine, the video machine includes a video display, a first selector for programmably controlling a screen image on the video display, a second selector, a third selector and first and second pay-off controls;

the player placing a first wager based upon the outcome of the game involving the cards and based upon the winning of the card game, wherein under the control of the player the first wager is placed by activating the second selector;

the player placing at least two second prop wagers independent from playing the card game itself and whether said player wins the card game, the second wager based upon playing for an occurrence of one or more suit, color, face card or odd and even numbered combinations of all cards that are dealt from the simulated deck to the player during the card game, wherein under the control of the player at least two second prop wagers are placed by activating the third selector;

the machine simulating the dealing of a hand of cards on the display to the player or players;

the machine selectively simulating the dealing or not dealing of a card or cards to the player based upon the decision of the player, wherein the decision by the player to have a card or cards dealt or not dealt is indicated by a state of the first selector;

the machine paying the player a benefit when the player wins the first wager based upon the winning of the card game, wherein the paying of the player of the benefit from winning the first wager is by the respective first video machine pay-off controls;

the machine paying the player a benefit when the player wins any second wager based upon the occurrence of one or more suit, color, face card or odd and even numbered combinations of cards as of the end of the game, independent of whether the player wins the first wager, wherein the paying of the player of the benefit from winning any second prop wager is by the respective second video machine pay-off controls.

* * * * *